US012338997B2

(12) United States Patent
Van Kampen et al.

(10) Patent No.: US 12,338,997 B2
(45) Date of Patent: Jun. 24, 2025

(54) APPARATUS AND METHOD CAPABLE OF MONITORING AND ADJUSTING IN-FURNACE COMBUSTION CONDITIONS IN REAL TIME

(71) Applicant: L'Air Liquide, Société Anonyme pour l'Etude et l'Exploitation des Procédés Georges Claude, Paris (FR)

(72) Inventors: Peter Van Kampen, Shanghai (CN); Yuejin Pan, Shanghai (CN); Gang Zhang, Shanghai (CN); Wenbiao Zhou, Shanghai (CN)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 445 days.

(21) Appl. No.: 17/789,458

(22) PCT Filed: Dec. 21, 2020

(86) PCT No.: PCT/CN2020/137960

§ 371 (c)(1),
(2) Date: Jun. 27, 2022

(87) PCT Pub. No.: WO2021/129564

PCT Pub. Date: Jul. 1, 2021

(65) Prior Publication Data

US 2023/0064445 A1 Mar. 2, 2023

(30) Foreign Application Priority Data

Dec. 27, 2019 (CN) ..... 201911378911.7

(51) Int. Cl.
*F23N 1/02* (2006.01)
*F23L 7/00* (2006.01)
(Continued)

(52) U.S. Cl.
CPC ..... *F23N 1/022* (2013.01); *F23L 7/007* (2013.01); *F23L 9/04* (2013.01); *F23N 5/265* (2013.01); *F23N 2900/00* (2013.01)

(58) Field of Classification Search
CPC .. F23L 7/007; F23L 9/04; F23N 1/002; F23N 5/265
(Continued)

(56) References Cited

U.S. PATENT DOCUMENTS 6,190,160 B1 2/2001 Hibon et al.
6,247,416 B1 6/2001 Beaudoin et al.
(Continued)

FOREIGN PATENT DOCUMENTS

CN 85201091 U 3/1986
CN 101484753 7/2009
(Continued)

OTHER PUBLICATIONS

International Search Report for corresponding PCT/CN2020/137960, Mar. 23, 2021.

*Primary Examiner* — Vivek K Shirsat
(74) *Attorney, Agent, or Firm* — Elwood L. Haynes

(57) ABSTRACT

An apparatus capable of monitoring and adjusting an in-furnace combustion condition in real time, having: a furnace having a heating chamber, a combustor, a charging door, an exhaust gas flow port, and an exhaust gas flow pipe, wherein the combustor is used for introducing fuel and/or an oxygen-containing gas into the heating chamber to form a flame, the charging door is used for adding a raw material, and the gas generated by combustion in the heating chamber enters the exhaust gas flow pipe through the exhaust gas flow port; two sensors of the same type arranged at different positions in the exhaust gas flow pipe; and a control device receiving signals of the two sensors and adjusting, according to a difference
(Continued)

between the signals, the amount of the fuel and/or the oxygen-containing gas entering the combustor.

17 Claims, 1 Drawing Sheet

(51) Int. Cl.
*F23L 9/04* (2006.01)
*F23N 5/26* (2006.01)

(58) Field of Classification Search
USPC ..... 431/75, 76
See application file for complete search history.

(56) References Cited

U.S. PATENT DOCUMENTS

| | | | |
|---|---|---|---|
| 6,533,574 | B1 | 3/2003 | Pechoux |
| 8,721,764 | B2 | 5/2014 | Rheker |
| 9,091,484 | B2 * | 7/2015 | Hegenberg ..... F27D 99/0001 |
| 2008/0113306 | A1 | 5/2008 | Veasey et al. |
| 2013/0115560 | A1 | 5/2013 | Beaudoin et al. |
| 2013/0307202 | A1 | 11/2013 | Hegenberg et al. |
| 2015/0184939 | A1 | 7/2015 | Nakagawa et al. |
| 2015/0308689 | A1 | 10/2015 | Yukimasa et al. |
| 2017/0082320 | A1 | 3/2017 | Wang et al. |
| 2017/0131734 | A1 | 5/2017 | Balteanu |
| 2020/0088406 | A1 * | 3/2020 | Murakami ..... F02D 41/1441 |

FOREIGN PATENT DOCUMENTS

| | | | |
|---|---|---|---|
| CN | 102138051 | A | 7/2011 |
| CN | 102859307 | | 1/2013 |
| CN | 103424005 | A | 12/2013 |
| CN | 104471079 | A | 3/2015 |
| CN | 104848247 | A | 8/2015 |
| CN | 106402928 | | 2/2017 |
| CN | 106642711 | | 5/2017 |
| CN | 106765163 | | 5/2017 |
| EP | 0 697 565 | | 2/1996 |
| ES | 2201885 | B1 | 6/2005 |
| JP | H01 312308 | | 12/1989 |
| JP | H09 88567 | | 3/1997 |
| JP | 2001 280849 | | 10/2001 |
| WO | WO 2019 034283 | | 2/2019 |

* cited by examiner

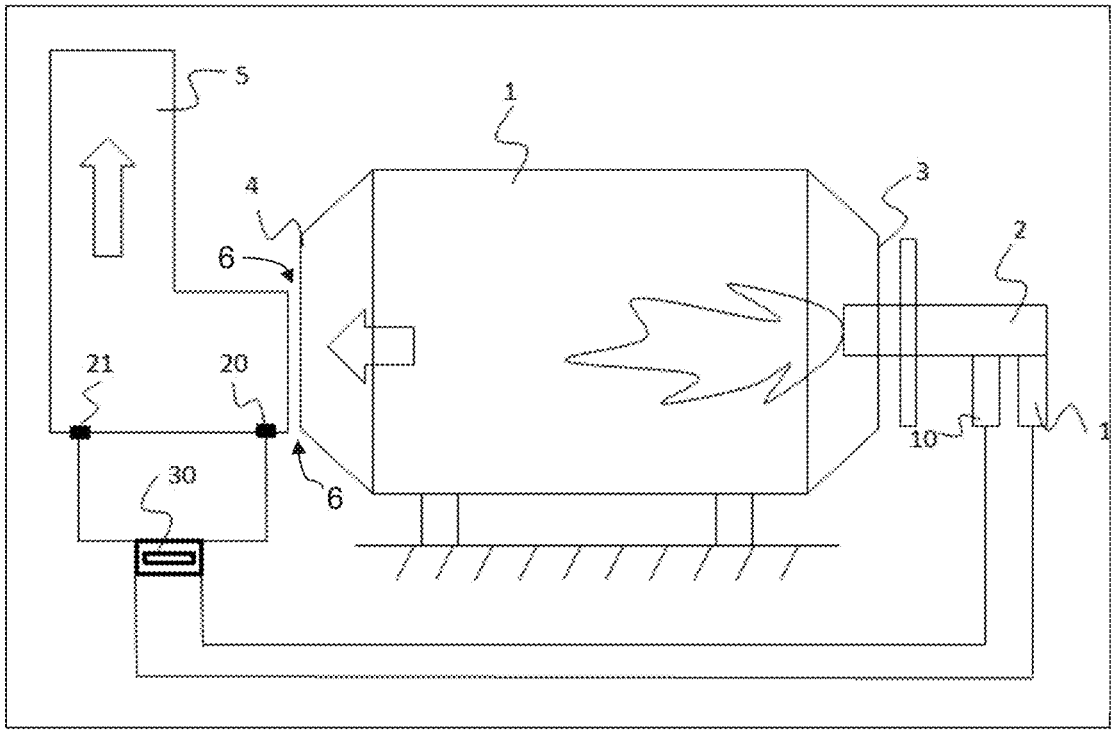
5
1
4
3
6
2
21
20
10
1
30
6

APPARATUS AND METHOD CAPABLE OF MONITORING AND ADJUSTING IN-FURNACE COMBUSTION CONDITIONS IN REAL TIME

CROSS REFERENCE TO RELATED APPLICATIONS

This application is a 371 of International Application No. PCT/CN2020/137960, filed Dec. 21, 2020, which claims priority to Chinese Patent Application No. 201911378911.7, filed Dec. 27, 2019, the entire contents of which are incorporated herein by reference.

TECHNICAL FIELD

The present invention belongs to the field of combustion, and relates to an apparatus and method for monitoring and adjusting the combustion conditions in a furnace.

BACKGROUND ART

Combustion has a wide range of applications in industry, e.g. the melting of metals, including aluminum, copper, lead, etc., or the incineration of waste containing organic matter. This type of combustion is generally carried out in an industrial combustion furnace. By feeding oxygen-containing gas, or fuel and oxygen-containing gas together, into the combustion furnace, a flame and a large amount of heat are generated. Since the composition and quality of the raw materials fed into the furnace often change, the combustion conditions in the furnace will also change accordingly. For example, when metal is melted, additives such as coal are sometimes added to the metal raw materials; paint, coatings and residue, etc. on cans contain a large amount of carbon; and various components in waste also contain a large amount of carbon. When these combustible carbon-containing compounds are exposed to an oxidant during the operation of the furnace, they will react to produce a large amount of carbon monoxide. This phenomenon is called carbon monoxide release. When the carbon monoxide further comes into contact with the oxidant, it will produce carbon dioxide and release a lot of heat. In the combustion furnace, in addition to the oxygen-enriched air introduced into the furnace cavity or heating chamber through the burner, fresh air is also introduced into the flue gas duct or exhaust gas stream duct. Therefore, if carbon monoxide enters the exhaust gas stream duct, it will come into contact with the fresh air and burn, producing carbon dioxide and at the same time releasing a lot of heat, which can increase the temperature of the exhaust gas stream by 300° C. or more. Such combustion caused by the contact between carbon monoxide and oxidant in the flue gas duct or exhaust gas stream duct is called post-combustion.

The amounts of fuel and oxygen-containing gas fed into the burner generally satisfy the stoichiometric ratio of oxygen required to achieve full combustion of the fuel, so that both the fuel and the oxygen are fully utilized. When the raw materials contain a large amount of carbon-containing materials, the combustion thereof with oxygen will consume oxygen, so that the fuel cannot be fully burned, resulting in waste of the fuel. Therefore, many methods have been disclosed in the prior art to monitor changes in the atmosphere in the combustion furnace and perform prompt adjustment of the flow rates of fuel and oxygen-containing gas.

CN103424005B has disclosed a method for heating metal raw materials in a combustion furnace; this includes installing at least one optical sensor in a heating chamber and/or exhaust gas stream to monitor the intensity of combustion, monitoring the variation dT/dt of the temperature T of the exhaust gas stream with time, and adjusting the fuel:oxygen ratio according to the results of monitoring. This method requires measurement of the temperature change with respect to time, which increases the complexity and cost of the sensor and control equipment thereof.

U.S. Pat. No. 8,721,764B has disclosed a method for melting metal in a combustion furnace, which includes measuring the temperature of flue gas at a predetermined time frequency downstream of the post-combustion region in the flue, and comparing this temperature with a threshold. When the value is greater than the threshold, the ratio of the fuel flow to the oxygen-containing gas flow is reduced so that the combustion furnace enters a reducing operating state. The accuracy of this method depends on the accuracy with which the threshold is determined.

In view of the above, the question of how to design an apparatus and method for real-time monitoring and adjustment of the combustion conditions in furnace to eliminate the above-mentioned defects and deficiencies in the prior art is an issue that urgently needs to be solved by the associated technicians in the industry.

SUMMARY OF THE INVENTION

In order to overcome the above-mentioned technical problems in the prior art, the present invention provides an economical, convenient and accurate apparatus and method for real-time monitoring and adjustment of combustion conditions in a furnace.

In one aspect, the present invention discloses an apparatus capable of real-time monitoring and adjustment of combustion conditions in a furnace, comprising:

a) providing a furnace having a heating chamber, a burner, a loading gate, an exhaust gas stream port and an exhaust gas stream duct, wherein the burner is used for introducing a fuel and/or an oxygen-containing gas into the heating chamber so as to form a flame, the loading gate is used for adding a raw material, and a gas produced by combustion in the heating chamber enters the exhaust gas stream duct via the exhaust gas stream port;

b) two sensors of the same type arranged at different positions in the exhaust gas stream duct;

c) a control device, for receiving signals of the two sensors, and adjusting the amount of fuel and/or oxygen-containing gas entering the burner according to the difference between the signals.

In another aspect, a first sensor is arranged close to the exhaust gas stream port, a second sensor is arranged 5-10 meters downstream of the first sensor, and the difference between the two sensor signals can be used to estimate an atmosphere state in the heating chamber and/or whether post-combustion occurs in the exhaust gas stream duct.

In another aspect, both sensors are flame sensors.

In another aspect, both sensors are temperature sensors.

In another aspect, both sensors are pressure sensors.

In another aspect, both sensors are oxygen concentration sensors.

In another aspect, both sensors are carbon monoxide concentration sensors.

In another aspect, both sensors are carbon dioxide concentration sensors.

In another aspect, the exhaust gas stream port is located on a chamber wall of the heating chamber, and a gap exists between the exhaust gas stream port and the exhaust gas stream duct, or the exhaust gas stream duct is built of a refractory material by masonry, and air can enter the exhaust gas stream duct through gaps in the refractory material.

The present invention also discloses a method for heating a raw material in the apparatus as described above, comprising:

a) introducing a fuel and/or an oxygen-containing gas into the heating chamber of the furnace via the burner, thereby forming a flame to heat the raw material, wherein a gas produced by combustion enters the exhaust gas stream duct via the exhaust gas stream port;

b) introducing air into the exhaust gas stream duct;

c) arranging at least two sensors of the same type in the exhaust gas stream duct, wherein a first sensor is arranged close to the exhaust gas stream port, and a second sensor is arranged 5-10 meters downstream of the first sensor; transmitting signals of the two sensors to a control device, which adjusts the amount of fuel and/or oxygen-containing gas entering the burner according to the difference between the two sensor signals.

In the method described above, air enters the exhaust gas stream duct through a gap between the exhaust gas stream port and the exhaust gas stream duct, or when the exhaust gas stream duct is built of a refractory material by masonry, air enters the exhaust gas stream duct through gaps in the refractory material.

In the method described above, the raw material comprises one of, and/or a mixture of more than one of, iron-containing, copper-containing, aluminum-containing and/or other-metal-containing materials, or the raw material comprises waste.

In the method described above, the oxygen-containing gas contains at least 80% oxygen by mole percent.

In the method described above, the fuel comprises one of, or a mixture of more than one of, natural gas, other hydrocarbons and petroleum coke.

In the method described above, the furnace comprises a rotary furnace, a reverberatory furnace and/or a shaft furnace.

In the method described above, the combustion conditions in the furnace comprise:

a) a reducing atmosphere when the actual content of oxygen in the furnace is less than the oxygen content theoretically required to achieve full combustion of combustible carbon-containing compounds in the furnace; or b) a neutral atmosphere when the actual content of oxygen in the furnace is approximately equal to the oxygen content theoretically required to achieve full combustion of combustible carbon-containing compounds in the furnace; or c) an oxidizing atmosphere when the actual content of oxygen in the furnace is higher than the oxygen content theoretically required to achieve full combustion of combustible carbon-containing compounds in the furnace.

In one aspect of the method described above, when both sensors are flame sensors, a) if both flame sensors detect a flame, it is inferred that the atmosphere in the furnace is a reducing atmosphere;

b) if the first flame sensor close to the exhaust gas stream port detects a flame at regular time intervals, but the second flame sensor remote from the exhaust gas stream port does not detect a flame, it is inferred that the atmosphere in the furnace is a neutral atmosphere; or c) if neither of the two flame sensors detects a flame, it is inferred that the atmosphere in the furnace is an oxidizing atmosphere.

In the method described above, when both sensors are temperature sensors, a) if the temperature detected by the first temperature sensor close to the exhaust gas stream port is higher than the temperature detected by the second temperature sensor remote from the exhaust gas stream port, it is inferred that the atmosphere in the furnace is a neutral or oxidizing atmosphere; or b) if the opposite is true, it is inferred that the atmosphere in the furnace is a reducing atmosphere.

In another aspect of the method described above, when both sensors are pressure sensors, a) if the pressure detected by the first pressure sensor close to the exhaust gas stream port is approximately equal to the pressure detected by the second pressure sensor remote from the exhaust gas stream port, it is inferred that the atmosphere in the furnace is a neutral or oxidizing atmosphere; or b) if the pressure detected by the first pressure sensor close to the exhaust gas stream port is lower than the pressure detected by the second pressure sensor remote from the exhaust gas stream port, it is inferred that the atmosphere in the furnace is a reducing atmosphere.

In the method described above, when both sensors are oxygen concentration sensors, a) if the oxygen concentration detected by the first oxygen concentration sensor close to the exhaust gas stream port is lower than a theoretical value for a neutral atmosphere but higher than the oxygen concentration detected by the second oxygen concentration sensor remote from the exhaust gas stream port, it is inferred that the atmosphere in the furnace is a reducing atmosphere;

b) if the oxygen concentration detected by the first oxygen concentration sensor close to the exhaust gas stream port is equal to the theoretical value for a neutral atmosphere, and slightly higher than the oxygen concentration detected by the second oxygen concentration sensor remote from the exhaust gas stream port, it is inferred that the atmosphere in the furnace is a neutral atmosphere and post-combustion occurs between the two oxygen concentration sensors; or c) if the oxygen concentrations detected by the two oxygen concentration sensors are both higher than the theoretical value for a neutral atmosphere, it is inferred that the atmosphere in the furnace is an oxidizing atmosphere.

In another aspect of the method described above, when both sensors are carbon monoxide concentration sensors, a) if the carbon monoxide concentration detected by the first carbon monoxide concentration sensor close to the exhaust gas stream port is higher than the carbon monoxide concentration detected by the second carbon monoxide concentration sensor remote from the exhaust gas stream port, it is inferred that the atmosphere in the furnace is a reducing atmosphere;

b) if the carbon monoxide concentration detected by the first carbon monoxide concentration sensor close to the exhaust gas stream port is equal to a theoretical value for a neutral atmosphere, and slightly higher than the carbon monoxide concentration detected by the second carbon monoxide concentration sensor remote from the exhaust gas stream port, it is inferred that the atmosphere in the furnace is a neutral atmosphere and post-combustion occurs between the two carbon monoxide concentration sensors; or c) if both carbon monoxide concentration sensors detect almost no carbon monoxide, it is inferred that the atmosphere in the furnace is an oxidizing atmosphere.

In another aspect of the method described above, when both sensors are carbon dioxide concentration sensors, a) if the carbon dioxide concentration detected by the first carbon dioxide concentration sensor close to the exhaust gas stream port is lower than the carbon dioxide concentration detected by the second carbon dioxide concentration sensor remote from the exhaust gas stream port, it is inferred that the atmosphere in the furnace is a reducing atmosphere;

b) if the carbon dioxide concentration detected by the first carbon dioxide concentration sensor close to the exhaust gas stream port is equal to a theoretical value for a neutral atmosphere, and slightly lower than the carbon dioxide concentration detected by the second carbon dioxide concentration sensor remote from the exhaust gas stream port, it is inferred that the atmosphere in the furnace is a neutral atmosphere and post-combustion occurs between the two carbon dioxide concentration sensors; or c) if the carbon dioxide concentrations detected by the two carbon dioxide concentration sensors are approximately equal, it is inferred that the atmosphere in the furnace is an oxidizing atmosphere.

In another aspect of the method described above, the control device realizes an ideal atmosphere in the heating chamber by adjusting the amount of fuel and/or oxygen-containing gas entering the burner, according to the inferred atmosphere state in the heating chamber and/or whether post-combustion occurs in the exhaust gas stream duct.

Compared with the prior art, the technical solution provided in the present invention has the following advantages:

1. It is suitable for all kinds of combustion furnaces and all kinds of raw materials.
2. It can detect various atmosphere conditions in the combustion furnace, not being limited to reducing atmospheres or oxidizing atmospheres.
3. The sensors and control device are structurally simple and low-priced.
4. The in-furnace atmosphere is adjusted on the basis of a comparison of the measured values of two sensors of the same type. There is no need for a complicated calibration process or theoretical calculations, so the technical solution is more direct, accurate and convenient.

BRIEF DESCRIPTION OF THE DRAWINGS

Further understanding of the advantages and spirit of the present invention can be gained through the following detailed description of the invention and the accompanying drawings.

FIG. 1 is a schematic diagram of the structure of the apparatus provided by the present invention.

In the FIGURE: 1—heating chamber; 2—burner; 3—loading gate; 4—exhaust gas stream port; 5—exhaust gas stream duct; 6—fresh air: 10—oxygen-containing gas pathway; 11—fuel pathway; 20—first sensor; 21—second sensor; 30—control device.

PREFERRED EMBODIMENTS OF THE INVENTION

Specific embodiments of the present invention are explained in detail below in conjunction with the accompanying drawings. However, the present invention should be understood to not be limited to embodiments such as those described below, and the technical concept of the present invention may be implemented in combination with other well-known technologies or other technologies having the same function as those well-known technologies.

In the description of the following specific embodiments, in order to clearly demonstrate the structure and manner of operation of the present invention, many directional words will be used for description, but words such as "front", "rear", "left", "right", "outer", "inner", "outward", "inward", "axial" and "radial" should be understood as being terms for convenience rather than restrictive terms.

In the description of the specific embodiments below, it should be understood that the orientational or positional relationships indicated by the terms "length", "width", "upper", "lower", "front", "rear", "left", "right", "vertical", "horizontal", "top", "bottom", "inner" and "outer", etc. are based on the orientational or positional relationships shown in the drawings, and are merely intended to facilitate description of the present invention and simplify the description, rather than indicating or implying that the apparatus or element referred to must have a specific orientation and be constructed and operated in a specific orientation, and therefore are not understood as being a limitation of the present invention.

In the present invention, unless otherwise clearly specified and defined, terms such as "installed", "connected together", "connected" and "fixed" should be understood in a broad sense, e.g. may mean connected in a fixed manner, but may also mean removably connected, or forming a single piece; may mean mechanically connected, but may also mean electrically connected; may mean directly connected together, but may also mean connected indirectly via an intermediate medium; and may mean internal communication between two elements, or an interactive relationship between two elements. Those skilled in the art can understand the specific meaning of the above terms in the present invention according to the specific circumstances.

Unless clearly indicated otherwise, each aspect or embodiment defined here can be combined with any other aspect(s) or embodiment(s). In particular, any preferred or advantageous feature indicated can be combined with any other preferred or advantageous feature indicated.

The combustion furnace in the present invention includes various types of furnace conventionally used in industry, such as a rotary furnace, also called a rotary drum furnace, or a reverberatory furnace, a shaft furnace, and the like. An appropriate furnace is chosen according to the type of raw material to be heated, cost considerations, and pollutant emission standards, etc. The region in the combustion furnace where the raw materials are heated and melted is the heating chamber. The burner extends into the heating chamber, and generates a flame in the heating chamber by inputting oxygen-containing gas, or oxygen-containing gas and fuel. The heat generated by the flame can melt metal and incinerate organic matter.

The flow rates of fuel and oxygen-containing gas passed into the burner are adjustable. If there are no other combustible substances in the heating chamber, the ratio of fuel to oxygen-containing gas can be adjusted so that the molar ratio of fuel to oxygen in the heating chamber satisfies the stoichiometric ratio for combustion of the fuel and oxygen. In such circumstances, the fuel and oxygen are completely burned. In theory, there will be no residual oxygen or fuel, and the atmosphere in the furnace is neutral. If the molar ratio of oxygen to fuel in the heating chamber exceeds the stoichiometric ratio for combustion of the fuel and oxygen, then the fuel is completely consumed, there is residual oxygen in the heating chamber, and the atmosphere in the furnace is an oxidizing atmosphere. If the molar ratio of oxygen to fuel in the heating chamber is less than the stoichiometric ratio for combustion of the fuel and oxygen, theoretically the oxygen is completely consumed, there is residual fuel and/or carbon monoxide in the heating chamber, and the atmosphere in the furnace is a reducing atmosphere.

Even if the ratio of fuel and oxygen-containing gas fed into the heating chamber satisfies the stoichiometric ratio for combustion of the fuel and oxygen-containing gas, it is not possible to guarantee that the atmosphere in the furnace is always a neutral atmosphere. This is due to the presence of impurities in the raw materials, and the contents and types of impurities in different batches of raw materials entering the heating chamber are often different. Taking the melting of recycled metal as an example, metal cans often have impurities such as coatings, paint, content residue, and plastics. Combustible carbon-containing components in these impurities will burn to produce carbon monoxide when they come into contact with oxygen at high temperatures. As a result, oxygen is consumed, so there is insufficient oxygen for complete combustion with fuel, and the main components in the furnace are excess fuel and generated carbon monoxide. Such an atmosphere is called a reducing atmosphere. If it is necessary to adjust the atmosphere in the furnace to a neutral atmosphere, the amount of fuel fed into the heating chamber can be reduced or the amount of oxygen fed into the heating chamber can be increased.

Although a neutral atmosphere can utilize the fuel and oxygen-containing gas fed into the heating chamber to the maximum extent, a neutral atmosphere is not always suitable from the perspective of raw material processing. For example, aluminum oxidizes easily; in order to avoid the loss of raw material, a reducing atmosphere should be maintained in the heating chamber. As another example, when waste is incinerated, most of the waste is combustible material. In such circumstances, it is possible to feed less fuel or no fuel into the heating chamber, and only feed in oxygen, thereby creating an oxidizing atmosphere in the heating chamber. If the metal being melted is a metal that is not easily oxidized such as copper or lead, a neutral atmosphere can be maintained in the heating chamber to avoid wasting fuel or oxygen. It can be seen that it is absolutely necessary to monitor the atmosphere in the heating chamber in real time, and adjust the flow rate of fuel or oxygen-containing gas as needed in order to achieve a suitable in-furnace atmosphere.

Gases generated in the heating chamber enter an exhaust gas stream duct through an exhaust gas stream port. There are various designs of exhaust gas stream duct. For example, there is a gap between the exhaust gas stream port and exhaust gas stream duct of a rotary furnace; a suction fan is installed in the exhaust gas stream duct to suck fresh air 6 from the gap into the exhaust gas stream duct in order to cool the high-temperature exhaust gas stream. The exhaust gas stream ducts of reverberatory furnaces and other furnaces are seamlessly connected to the exhaust gas stream ports, and the exhaust gas stream ducts are built of a refractory material by masonry; the pressure difference between the inside and outside of the ducts allows fresh air 6 to penetrate into the ducts through gaps in the refractory material, and this can also have the effect of cooling the high-temperature exhaust gas stream. However, if the atmosphere in the furnace is a reducing atmosphere, the exhaust gas stream contains a large amount of carbon monoxide. When carbon monoxide at a high temperature encounters fresh air 6 containing oxygen in the exhaust gas stream duct, it will burn to produce carbon dioxide. Such combustion occurs in the exhaust gas stream duct outside the heating chamber, and is called post-combustion. Post-combustion releases a lot of heat, which might cause aging of and damage to the exhaust gas stream duct. It can be concluded from the presence of post-combustion that the exhaust gas stream contains a large amount of carbon monoxide, and it can be further concluded that the atmosphere in the heating chamber is a reducing atmosphere.

A sensor is an element that measures a particular set parameter, converts it to an electrical signal, and then transmits this signal to a control device by a wireless and/or wired method. Sensors suitable for the present invention include flame sensors, temperature sensors, pressure sensors, oxygen concentration sensors, carbon monoxide concentration sensors, carbon dioxide concentration sensors, and the like. The sensor can be conventionally selected from various commercially available models as required. The control device receives the signal from the sensor and makes a logical judgment as to whether to adjust the flow rates of fuel and oxygen-containing gas, and on the basis of this judgment, adjusts the flow rates of fuel and/or oxygen-containing gas accordingly. An example of a suitable control device is a programmable logic controller (PLC).

FIG. 1 describes an embodiment of the present invention. A burner 2 and a loading gate 3 are installed at one end of the heating chamber 1; raw material to be heated enters the heating chamber 1 through the loading gate 3. An oxygen-containing gas pathway 10 and a fuel pathway 11 are provided in the burner 2; fuel and oxygen-containing gas form a flame in the heating chamber 1. Gas in the heating chamber 1 exits from an exhaust gas stream port 4. In this embodiment, there is a gap between the exhaust gas stream port 4 and an exhaust gas stream duct 5, to allow fresh air 6 to enter the exhaust gas stream duct 5. Two sensors of the same type are provided in the exhaust gas stream duct 5. Of these, a first sensor 20 is arranged close to the exhaust gas stream port 4; data measured by the first sensor essentially reflects the nature of gas that has just left the interior of the heating chamber. A second sensor 21 is arranged 5-10 meters downstream of the first sensor; the exact position is determined through experiment or experience, the aim being to arrange the second sensor downstream of possible post-combustion. If there is post-combustion in the exhaust gas stream duct, data measured at the position of the second sensor 21 reflects the nature of gas after combustion has occurred. The two sensors transmit measured signals to a control device 30, and the control device 30 adjusts the flow rate of fuel and/or oxygen-containing gas according to the difference between the signals of the two sensors, thus achieving the objective of changing the atmosphere in the heating chamber.

Specifically, the two sensors can both be flame sensors. Commonly used flame detection sensors include ultraviolet and infrared flame detection sensors, both of which can detect the intensity of radiation in a specific wavelength range, and convert this to an electrical signal. In the present invention, an ultraviolet flame detection sensor is generally selected according to the nature of the flame; the flame detection sensor only needs to detect whether a flame is present, without needing to detect the intensity of the flame. When there is a reducing atmosphere in the heating chamber, the exhaust gas stream contains a large amount of carbon monoxide which, after entering the exhaust gas stream duct, comes into contact with fresh air 6 and burns, producing a flame. At this time, the two sensors arranged in the exhaust gas stream duct can both detect the flame. If the atmosphere in the heating chamber is neutral, the ratio of oxygen to fuel is essentially able to ensure complete combustion of the fuel. However, every time the loading gate 3 is opened to add raw material, some carbon-containing impurities are inevitably introduced into the heating chamber, and these impurities will burn with oxygen to produce carbon monoxide. Therefore, as the loading gate is periodically opened, gusts of carbon monoxide are also periodically released in the heating chamber. Immediately after entering the exhaust gas stream duct, the carbon monoxide mixes with fresh air 6 and burns; therefore, the first flame sensor arranged at the exhaust gas stream port will detect a flame at the time intervals at which the loading gate is opened. Because the concentration of carbon monoxide in the neutral atmosphere will not be too high, it burns almost completely at the exhaust gas stream port, and the second flame sensor located deep inside the exhaust gas stream duct will not detect a flame. When the heating chamber is an oxidizing atmosphere, there is no incompletely burned carbon monoxide in the exhaust gas stream, and no post-combustion will occur in the exhaust gas stream duct, so neither of the two flame detection sensors can detect a flame.

Alternatively, both sensors can be temperature sensors. Temperature sensors are mainly divided into thermistors and thermocouples according to the measuring element; thermocouple temperature sensors are preferably used in the present invention. When there is a reducing atmosphere in the heating chamber, the exhaust gas stream contains a large amount of carbon monoxide which, after entering the exhaust gas stream duct, comes into contact with fresh air 6 and burns, so the temperature of the gas will rise. At this time, the second temperature sensor arranged deep down the exhaust gas stream duct detects the temperature of the gas after post-combustion, and this temperature should be higher than the temperature of the gas before post-combustion detected by the first temperature sensor located at the exhaust gas stream port. When there is an oxidizing or neutral atmosphere in the heating chamber, no post-combustion will occur in the exhaust gas stream duct; the exhaust gas is cooled by fresh air 6 in the exhaust gas stream duct, so the temperature detected by the second sensor is lower than the temperature detected by the first sensor.

Optionally, both sensors are pressure sensors. Suitable pressure sensors include pressure transmitters. When there is a reducing atmosphere in the heating chamber, the exhaust gas stream contains a large amount of carbon monoxide which, after entering the exhaust gas stream duct, comes into contact with fresh air 6 and burns. The combustion causes the gas to expand, the temperature rises, and the gas pressure rises correspondingly. At this time, the second pressure sensor arranged deep down the exhaust gas stream duct detects the pressure of the gas after post-combustion, and this pressure should be higher than the pressure of the gas before post-combustion detected by the first pressure sensor located at the exhaust gas stream port. When there is an oxidizing or neutral atmosphere in the heating chamber, no post-combustion will occur in the exhaust gas stream duct, so the pressures detected by the two pressure sensors are approximately equal.

Both sensors can also be oxygen concentration sensors. When combustion in the heating chamber only occurs in a stoichiometric ratio between oxygen and fuel, there is still a residual concentration of oxygen in the heating chamber, and this is the theoretical oxygen value for a neutral atmosphere. When there is a reducing atmosphere in the heating chamber, this means that a greater amount of oxygen is consumed by combustion with carbon-containing impurities. In such circumstances, the oxygen concentration detected by the first oxygen concentration sensor located at the exhaust gas stream port is lower than the theoretical oxygen value for a neutral atmosphere, and because post-combustion in the exhaust gas stream duct continues to consume oxygen, the oxygen concentration detected by the second oxygen concentration sensor located deep down the exhaust gas stream duct is further reduced. When the atmosphere in the heating chamber is neutral, the oxygen concentration detected by the first oxygen concentration sensor is approximately equal to the theoretical oxygen value for a neutral atmosphere; if a small amount of post-combustion occurs in the exhaust gas stream duct and oxygen thus continues to be consumed, the oxygen concentration detected by the second oxygen concentration sensor is further reduced. When there is an oxidizing atmosphere in the heating chamber, the oxygen concentrations detected by both oxygen concentration sensors are greater than the theoretical oxygen value for a neutral atmosphere.

Both sensors can also be carbon monoxide concentration sensors. When combustion in the heating chamber only occurs in a stoichiometric ratio between oxygen and fuel, the carbon monoxide in the heating chamber has a reference concentration, which is the theoretical carbon monoxide value for a neutral atmosphere. When there is a reducing atmosphere in the heating chamber, post-combustion occurs in the exhaust gas stream duct, and consumes carbon monoxide. Therefore, the carbon monoxide concentration detected by the first carbon monoxide concentration sensor located at the exhaust gas stream port is higher than the carbon monoxide concentration detected by the second carbon monoxide concentration sensor located deep down the exhaust gas stream duct. When the atmosphere in the heating chamber is neutral, the carbon monoxide concentration detected by the first carbon monoxide concentration sensor is approximately equal to the theoretical carbon monoxide value for a neutral atmosphere; if a small amount of post-combustion occurs in the exhaust gas stream duct and carbon monoxide thus continues to be consumed, the carbon monoxide concentration detected by the second carbon monoxide concentration sensor is further reduced. When there is an oxidizing atmosphere in the heating chamber, the carbon monoxide in the heating chamber reacts with oxygen to produce carbon dioxide, and the two carbon monoxide concentration sensors detect almost no carbon monoxide.

Both sensors can also be carbon dioxide concentration sensors. When combustion in the heating chamber only occurs in a stoichiometric ratio between oxygen and fuel, the carbon dioxide in the heating chamber has a reference concentration, which is the theoretical carbon dioxide value for a neutral atmosphere. When there is a reducing atmosphere in the heating chamber, post-combustion occurs in the exhaust gas stream duct, consuming carbon monoxide and producing carbon dioxide. Therefore, the carbon dioxide concentration detected by the first carbon dioxide concentration sensor located at the exhaust gas stream port is lower than the carbon dioxide concentration detected by the second carbon dioxide concentration sensor located deep down the exhaust gas stream duct. When the atmosphere in the heating chamber is neutral, the carbon dioxide concentration detected by the first carbon dioxide concentration sensor is approximately equal to the theoretical carbon dioxide value for a neutral atmosphere. If a small amount of post-combustion occurs in the exhaust gas stream duct and carbon dioxide thus continues to be produced, the carbon dioxide concentration detected by the second carbon dioxide concentration sensor will increase. When there is an oxidizing atmosphere in the heating chamber, post-combustion cannot possibly occur, and the carbon dioxide concentrations detected by the two carbon dioxide concentration sensors are approximately equal.

If a reducing atmosphere in the heating chamber needs to be adjusted to a neutral atmosphere, the input of fuel can be reduced or the input of oxygen-containing gas can be increased, so that the amount of oxygen in the heating chamber is sufficient for complete combustion with fuel and other carbon-containing impurities. Conversely, if an oxidizing atmosphere in the heating chamber needs to be adjusted to a neutral atmosphere, the input of fuel can be increased or the input of oxygen-containing gas can be reduced.

Unless stated otherwise, qualifiers similar to "first" and "second" appearing herein do not indicate a definition of chronological order, quantity or importance, but are merely intended to distinguish one technical feature in this technical solution from another technical feature. Similarly, qualifiers similar to "a" appearing herein do not indicate a definition of quantity, but describe a technical feature that has not appeared in the preceding text. Similarly, modifiers similar to "about" and "approximately" appearing in front of numerals herein generally include the number itself, and the specific meaning thereof should be understood in conjunction with the meaning of the context. Similarly, unless modified by a specific quantity measure word, nouns herein should be regarded as including both singular and plural forms, i.e. the technical solution may include a single one of the technical feature concerned, but may also include a plurality of the technical feature.

The above are merely preferred particular embodiments of the present invention, which are merely intended to illustrate the technical solution of the present invention without limiting the present invention. All technical solutions obtainable by those skilled in the art according to the concept of the present invention by logical analysis, reasoning or limited experiment should be included in the scope of the present invention.

The invention claimed is:

1. An apparatus configured for real-time monitoring and adjustment of combustion conditions in a furnace, comprising:

a) a furnace having a heating chamber, a burner, a loading gate, an exhaust gas stream port and an exhaust gas stream duct, wherein the burner is configured for introducing a fuel and/or an oxygen-containing gas into the heating chamber so as to form a flame, the loading gate is used for adding a raw material, and a gas produced by combustion in the heating chamber enters the exhaust gas stream duct via the exhaust gas stream port;

b) a first sensor and a second sensor of the same type arranged at different positions in the exhaust gas stream duct, and the first sensor is arranged close to the exhaust gas stream port, the second sensor is arranged 5-10 meters downstream of the first sensor, and the difference between the two sensor signals can be used to estimate an atmosphere state in the heating chamber and/or whether post-combustion occurs in the exhaust gas stream duct;

c) a control device, for receiving signals of the two sensors, and adjusting the amount of fuel and/or oxygen-containing gas entering the burner according to the difference between the signals wherein both sensors are selected from flame sensors, pressure sensors, oxygen concentration sensors, carbon monoxide concentration sensors or carbon dioxide concentration sensors, wherein the exhaust gas stream duct is built of a refractory material by masonry, and air can enter the exhaust gas stream duct through gaps in the refractory material.

2. The apparatus as claimed in claim 1, wherein the exhaust gas stream port is located on a chamber wall of the heating chamber, and a gap exists between the exhaust gas stream port and the exhaust gas stream duct.

3. A method for heating a raw material in the apparatus as claimed in claim 1, comprising:

a) introducing the fuel and/or the oxygen-containing gas into the heating chamber of the furnace via the burner, thereby forming the flame to heat the raw material, wherein the gas produced by combustion enters the exhaust gas stream duct via the exhaust gas stream port;

b) introducing air into the exhaust gas stream duct;

c) arranging the first sensor and the second sensor of the same type in the exhaust gas stream duct, wherein the first sensor is arranged close to the exhaust gas stream port, and the second sensor is arranged 5-10 meters downstream of the first sensor; transmitting signals of the two sensors to the control device, which adjusts the amount of fuel and/or oxygen-containing gas entering the burner according to the difference between the two sensor signals.

4. The method as claimed in claim 3, wherein a portion of the air enters the exhaust gas stream duct through a gap between the exhaust gas stream port and the exhaust gas stream duct.

5. The method as claimed in claim 3, wherein when the exhaust gas stream duct is built of a refractory material by masonry, and at least a portion of the air that enters the exhaust gas stream duct enters through gaps in the refractory material.

6. The method as claimed in claim 3, wherein the raw material comprises any of iron-containing, copper-containing, aluminum-containing or other-metal-containing materials and/or any mixture thereof.

7. The method as claimed in claim 3, wherein the raw material comprises waste.

8. The method as claimed in claim 3, wherein the oxygen-containing gas contains at least 80% oxygen by mole percent.

9. The method as claimed in claim 3, wherein the fuel comprises any of natural gas, other hydrocarbons, petroleum coke and/or any mixture thereof.

10. The method as claimed in claim 3, wherein the furnace comprises a rotary furnace, a reverberatory furnace and/or a shaft furnace.

11. The method as claimed in claim 3, wherein the combustion conditions in the furnace comprise:

a) a reducing atmosphere when the actual content of oxygen in the furnace is less than the oxygen content theoretically required to achieve full combustion of combustible carbon-containing compounds in the furnace; or b) a neutral atmosphere when the actual content of oxygen in the furnace is approximately equal to the oxygen content theoretically required to achieve full combustion of combustible carbon-containing compounds in the furnace; or c) an oxidizing atmosphere when the actual content of oxygen in the furnace is higher than the oxygen content theoretically required to achieve full combustion of combustible carbon-containing compounds in the furnace.

12. The method as claimed in claim 11, wherein when both sensors are flame sensors, a) if both flame sensors detect a flame, it is inferred that the atmosphere in the furnace is a reducing atmosphere;

b) if the first flame sensor close to the exhaust gas stream port detects a flame at regular time intervals, but the second flame sensor remote from the exhaust gas stream port does not detect a flame, it is inferred that the atmosphere in the furnace is a neutral atmosphere; or c) if neither of the two flame sensors detects a flame, it is inferred that the atmosphere in the furnace is an oxidizing atmosphere.

13. The method as claimed in claim 11, wherein when both sensors are pressure sensors, a) if the pressure detected by the first pressure sensor close to the exhaust gas stream port is approximately equal to the pressure detected by the second pressure sensor remote from the exhaust gas stream port, it is inferred that the atmosphere in the furnace is a neutral or oxidizing atmosphere; or b) if the pressure detected by the first pressure sensor close to the exhaust gas stream port is lower than the pressure detected by the second pressure sensor remote from the exhaust gas stream port, it is inferred that the atmosphere in the furnace is a reducing atmosphere.

14. The method as claimed in claim 11, wherein when both sensors are oxygen concentration sensors, a) if the oxygen concentration detected by the first oxygen concentration sensor close to the exhaust gas stream port is lower than a theoretical value for a neutral atmosphere but higher than the oxygen concentration detected by the second oxygen concentration sensor remote from the exhaust gas stream port, it is inferred that the atmosphere in the furnace is a reducing atmosphere;

b) if the oxygen concentration detected by the first oxygen concentration sensor close to the exhaust gas stream port is equal to the theoretical value for a neutral atmosphere, and slightly higher than the oxygen concentration detected by the second oxygen concentration sensor remote from the exhaust gas stream port, it is inferred that the atmosphere in the furnace is a neutral atmosphere and post-combustion occurs between the two oxygen concentration sensors; or c) if the oxygen concentrations detected by the two oxygen concentration sensors are both higher than the theoretical value for a neutral atmosphere, it is inferred that the atmosphere in the furnace is an oxidizing atmosphere.

15. The method as claimed in claim 11, wherein when both sensors are carbon monoxide concentration sensors, a) if the carbon monoxide concentration detected by the first carbon monoxide concentration sensor close to the exhaust gas stream port is higher than the carbon monoxide concentration detected by the second carbon monoxide concentration sensor remote from the exhaust gas stream port, it is inferred that the atmosphere in the furnace is a reducing atmosphere;

b) if the carbon monoxide concentration detected by the first carbon monoxide concentration sensor close to the exhaust gas stream port is equal to a theoretical value for a neutral atmosphere, and slightly higher than the carbon monoxide concentration detected by the second carbon monoxide concentration sensor remote from the exhaust gas stream port, it is inferred that the atmosphere in the furnace is a neutral atmosphere and post-combustion occurs between the two carbon monoxide concentration sensors; or c) if both carbon monoxide concentration sensors detect almost no carbon monoxide, it is inferred that the atmosphere in the furnace is an oxidizing atmosphere.

16. The method as claimed in claim 11, wherein when both sensors are carbon dioxide concentration sensors, a) if the carbon dioxide concentration detected by the first carbon dioxide concentration sensor close to the exhaust gas stream port is lower than the carbon dioxide concentration detected by the second carbon dioxide concentration sensor remote from the exhaust gas stream port, it is inferred that the atmosphere in the furnace is a reducing atmosphere;

b) if the carbon dioxide concentration detected by the first carbon dioxide concentration sensor close to the exhaust gas stream port is equal to a theoretical value for a neutral atmosphere, and slightly lower than the carbon dioxide concentration detected by the second carbon dioxide concentration sensor remote from the exhaust gas stream port, it is inferred that the atmosphere in the furnace is a neutral atmosphere and post-combustion occurs between the two carbon dioxide concentration sensors; or c) if the carbon dioxide concentrations detected by the two carbon dioxide concentration sensors are approximately equal, it is inferred that the atmosphere in the furnace is an oxidizing atmosphere.

17. The method as claimed in claim 11, wherein the control device realizes an ideal atmosphere in the heating chamber by adjusting the amount of fuel and/or oxygen-containing gas entering the burner, according to the inferred atmosphere state in the heating chamber and/or whether post-combustion occurs in the exhaust gas stream duct.

* * * * *